US010657855B2

(12) United States Patent
Matsuoka et al.

(10) Patent No.: US 10,657,855 B2
(45) Date of Patent: May 19, 2020

(54) VEHICLE

(71) Applicant: Toyota Jidosha Kabushiki Kaisha, Toyota-shi Aichi-ken (JP)

(72) Inventors: Tomohito Matsuoka, Nagoya Aichi-ken (JP); Seiichi Tsunoda, Nisshin Aichi-ken (JP); Jiro Goto, Seto Aichi-ken (JP); Masayuki Yamada, Chofu Tokyo-to (JP); Yasutaka Eto, Okazaki Aichi-ken (JP); Keima Fukunaga, Toyota Aichi-ken (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 34 days.

(21) Appl. No.: 16/225,993

(22) Filed: Dec. 19, 2018

(65) Prior Publication Data

US 2019/0197927 A1 Jun. 27, 2019

(30) Foreign Application Priority Data

Dec. 26, 2017 (JP) ..... 2017-249698

(51) Int. Cl.
*G09F 21/04* (2006.01)
*G09F 15/00* (2006.01)

(52) U.S. Cl.
CPC ..... *G09F 21/048* (2013.01); *G09F 15/0056* (2013.01); *G09F 15/0043* (2013.01)

(58) Field of Classification Search
CPC ..... G09F 21/048; G09F 15/0056; G09F 15/0043; B60S 9/14; B62D 61/10; B62D 63/025
See application file for complete search history.

(56) References Cited

U.S. PATENT DOCUMENTS 3,002,762 A * 10/1961 Scheel ..... B62D 7/144 280/81.5
3,414,072 A * 12/1968 Wetmore, Jr. ..... B62D 59/04 180/24

(Continued)

FOREIGN PATENT DOCUMENTS

CN 1361032 A 7/2002
CN 1496315 A 5/2004

(Continued)

OTHER PUBLICATIONS

"42nd Tokyo Motor Show 2011", Nov. 2, 2015; URL: https://web.archive.org/web/20151102033142/https://www.webcg.net/articles/-/568.

(Continued)

*Primary Examiner* — Gary C Hoge
(74) *Attorney, Agent, or Firm* — Dinsmore & Shohl LLP

(57) ABSTRACT

A vehicle includes a substantially box-shaped body, wheels disposed on four corners of the vehicle, and at least one side display disposed on either or both exterior side surfaces of the body for displaying images and videos. The side display stretches lower than a top of the wheels along the vertical axis of the vehicle and wider than between inside ends of the wheels along the longitudinal axis of the vehicle. The lower edge of the side display is curbed or bent upwards at both ends to avoid overlapping with the wheels.

6 Claims, 9 Drawing Sheets

(56) References Cited

U.S. PATENT DOCUMENTS

| | | | | |
|---|---|---|---|---|
| 5,507,109 | A * | 4/1996 | Rinzler | G09F 15/0025 160/329 |
| 6,254,170 | B1 * | 7/2001 | Farmer | B60J 11/06 150/166 |
| 6,598,327 | B1 * | 7/2003 | Strzeletz | G09F 21/04 40/558 |
| 2004/0012162 | A1 | 1/2004 | Burke | |
| 2004/0111938 | A1 * | 6/2004 | Ozawa | G09F 21/04 40/591 |
| 2004/0231208 | A1 * | 11/2004 | Pitt | G09F 21/04 40/590 |
| 2007/0035109 | A1 * | 2/2007 | Yamanaka | A63G 25/00 280/727 |
| 2008/0030427 | A1 * | 2/2008 | Lanham | G09F 21/06 345/2.3 |
| 2008/0084360 | A1 * | 4/2008 | Shingai | G09F 9/33 345/1.3 |
| 2008/0143141 | A1 | 6/2008 | Ruslanov et al. | |
| 2013/0241236 | A1 * | 9/2013 | Vitale | B62D 21/14 296/193.04 |
| 2015/0032328 | A1 * | 1/2015 | Healey | B60W 50/14 701/36 |
| 2016/0207418 | A1 * | 7/2016 | Bergstrom | B60L 50/64 |
| 2018/0111539 | A1 * | 4/2018 | Cohen | G09F 21/048 |
| 2018/0186272 | A1 * | 7/2018 | Borden | G09F 21/048 |
| 2018/0345971 | A1 * | 12/2018 | Birnschein | B60W 10/22 |
| 2019/0213931 | A1 * | 7/2019 | Brubaker | B60Q 1/44 |

FOREIGN PATENT DOCUMENTS

| | | | |
|---|---|---|---|
| CN | 201773557 | U | 3/2011 |
| CN | 105206186 | A | 12/2015 |
| JP | H11189044 | A | 7/1999 |
| JP | 2002-186119 | A | 6/2002 |
| JP | 2004-258254 | A | 9/2004 |
| JP | 2015-505076 | A | 2/2015 |

OTHER PUBLICATIONS

"To Aeon Mall at Kaihin-Makuhari Shin-Toshin, for Riding Automatically Driven Bus, 'Robot Shuttle'", Aug. 26, 2016; URL: https://web.archive.org/web/20160826235910/http://robot start.info/2016/08/09/robot_shuttle_aeon.html.

"Level 4 = Rode Completely Automatically Driven Bus!", Jul. 26, 2017; URL: https://web.archive.org/web/20170726052831/http://minkara.carview.co.jp/userid/285744/blog/40123937/.

* cited by examiner

VEHICLE

CROSS REFERENCE TO RELATED APPLICATION

This application claims priority to Japanese Patent Application No. 2017-249698 filed on Dec. 26, 2017, which is incorporated herein by reference in its entirety including the specification, claims, drawings, and abstract.

TECHNICAL FIELD

The present disclosure relates to a vehicle including a display for displaying images and videos on an exterior surface.

BACKGROUND

Conventionally, it has been proposed to use vehicles for not only transportation means but also advertisement means. For example, JP 2004-258254A discloses a vehicle serving both as advertisement and transportation means. The vehicle includes a liquid crystal display on at least one side surface of vehicle exterior surfaces. According to the disclosure, the advertisement becomes movable and can be shown in a wide range of locations.

However, in the vehicle disclosed in JP 2004-258254A, because the lower edge of the liquid crystal display is above the top of the vehicle wheels, the size of the liquid crystal display is likely to be small relative to the size of the vehicle. A smaller liquid crystal display may reduce public attention, lowering advertising or warning effects.

The present specification discloses a vehicle which can enhance advertising or warning effects.

SUMMARY

A vehicle according to an embodiment of the present disclosure includes a substantially box-shaped body, two or more wheels disposed on four corners of the vehicle, and at least one side display disposed on either or both, exterior side surfaces of the body for displaying image or video. The side display stretches lower than a top of the two or more wheels along a vertical axis of the vehicle and wider than between inside ends of the two or more wheels along a longitudinal axis of the vehicle. A lower edge of the at least one, side display is curved or bent upwards at both ends to avoid overlapping with the two or more wheels.

The above-described structure achieves a side display which is large relative to the size of the vehicle, enhancing advertising or warning effects.

The two or more wheels may include a pair of first front wheels disposed on both sides of the vehicle around a front end of the vehicle, a pair of second front wheels disposed at the rear and in the vicinity of the pair of first front wheels, a pair of first rear wheels disposed on both sides of the vehicle around a rear end of the vehicle, and a pair of second rear wheels disposed at the front and in the vicinity of the pair of first rear wheels. Along the longitudinal axis of the vehicle, the side display may stretch wider than between inside ends of the pair of first front wheels and the pair of first rear wheels.

The eight wheel structure of the vehicle can reduce load acting on a single wheel, allowing use of small diameter wheels. This can achieve a more spacious passenger compartment and a larger display area of the side display. Further, because, along the longitudinal axis of the vehicle, the side display stretches wider than between inside ends of the pair of first front wheels and the pair of the first rear wheels, the side display can be made large relative to the size of the vehicle.

The vehicle may include a front end unit disposed at the front of the vehicle, a rear end unit disposed at the rear of the vehicle, and at least one intermediate unit disposed between the front end unit and the rear end unit. The front end unit, the rear end unit, and the at least one intermediate unit may be mechanically and electrically connected along the longitudinal axis of the vehicle, Each of the front end unit, the rear end unit, and the at least one intermediate unit may include at least one display panel disposed on either or both exterior side surfaces of the unit. The side display may include two or more display panels.

The above-described structure achieves a vehicle whose size can be changed according to applications.

On at least one side surface, the at least one intermediate unit may include an ingress/egress opening stretching across an entire width of the intermediate unit along the longitudinal axis of the vehicle, and a door which opens and closes the ingress/egress opening. Each of the two or more display panels of the side display stretches across a substantially entire surface of the door.

A large pillarless ingress/egress opening can be achieved for a vehicle combining two or more intermediate units by making, the ingress/egress opening of each intermediate unit stretch across the entire width of the intermediate unit. A large side display can be achieved by making the display panel stretch across a substantially entire area of the door.

The vehicle may include three or more intermediate units. The door may be a sliding door which slides along the longitudinal axis of the vehicle. When opened, two or more of the doors may overlap in the direction of their thickness on a side of the front end unit or the rear end unit.

The above-described structure can prevent each door from covering a part of the ingress/egress opening when the door is opened.

The vehicle may include a pair of vehicle end portions at both of the front and rear ends of the vehicle. Each of the end portions may have functions both as a vehicle front end portion and a vehicle rear end portion. When the traveling direction of the vehicle is reversed, the rotation direction of the two or more wheels is reversed, and the functions of the vehicle end portions may be switched such that the vehicle end portion serving as the vehicle front end portion before the reverse becomes the vehicle rear end portion, whereas the vehicle end portion serving as the vehicle rear end portion before the reverse becomes the vehicle front end portion.

The above-described structure can achieve a rapid reverse in a narrow space without requiring the vehicle to make a U-turn.

According to a vehicle of the present disclosure, a large display relative to die size of the vehicle can be achieved, enhancing advertising or warning effects.

DESCRIPTION OF EMBODIMENTS

Figure 1:
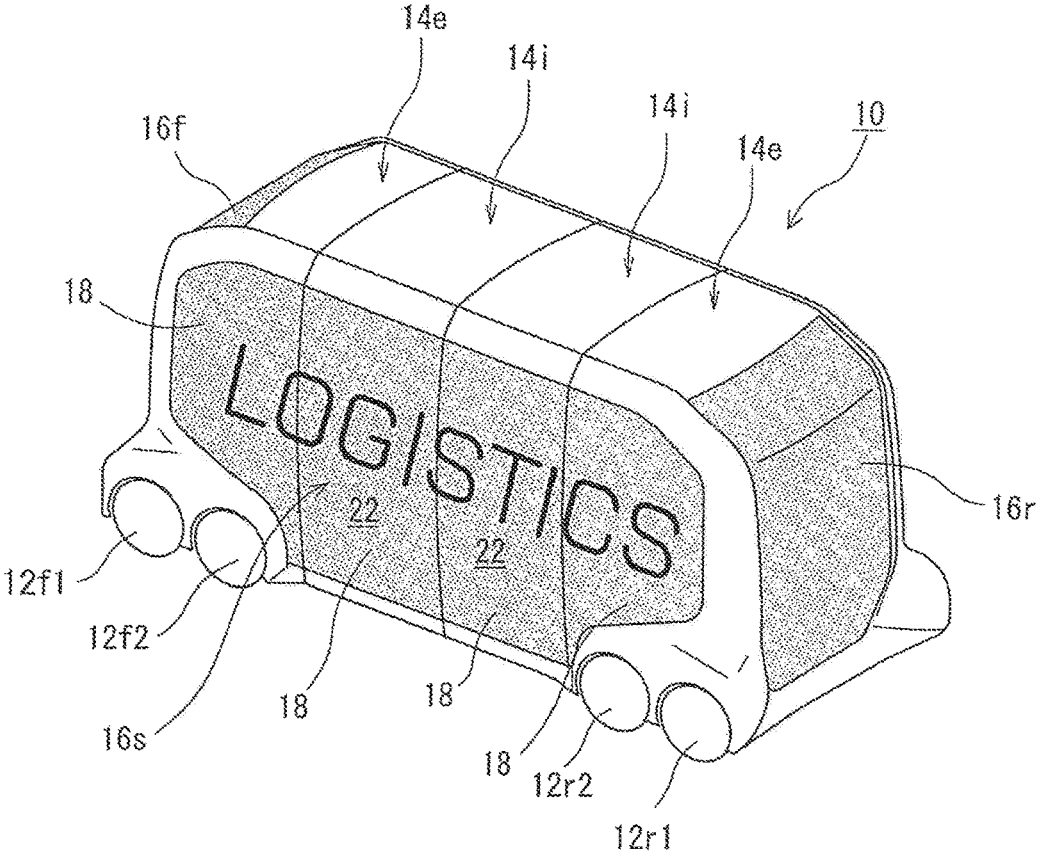
FIG. 1 is a perspective view of a vehicle according to one embodiment of the present disclosure.
Figure 2:
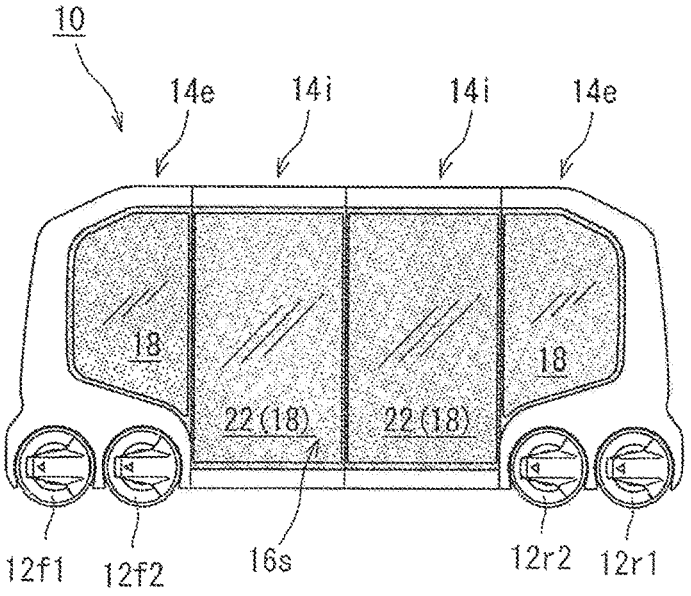
FIG. 2 is a side view of a vehicle according to one embodiment of the present disclosure.
Figure 3:
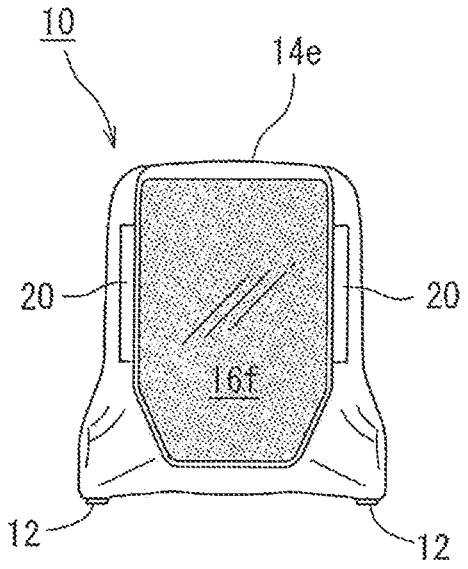
FIG. 3 is front view of a vehicle according to one embodiment of the present disclosure.

Embodiments of vehicle 10 according to the present disclosure are described in detail below with reference to the attached drawings. FIG. 1 is a perspective view of a vehicle 10 according to an embodiment of the present disclosure. FIGS. 2 and 3 respectively show a side view and a front view of the vehicle 10.

The vehicle 10 disclosed in the present disclosure may be mainly used as a movable business space. The vehicle 10 is automatically driven on a public road. The application of the vehicle 10 can be changed as necessary. For example, the vehicle 10 may be used as a retail store for displaying and selling a variety of products, or a shop for preparing and selling food and drink. As another embodiment, the vehicle 10 may be used as an office space for processing paperwork or having a meeting with a client. The vehicle 10 may also be used as a taxi, bus, or other transporting vehicle for transporting passengers or packages. The vehicle 10 is not limited to a business use, but may be personally used as a transporting means.

The vehicle 10 includes a variety of sensors for sensing external environments. The vehicle 10 is automatically driven on a public road according 10 information sensed by these sensors. The vehicle 10 includes a communication device for communicating with other communication devices (for example, a communication terminal installed on another vehicle 10 or a mobile terminal carried by a client). A variety of applications of the vehicle 10 are available. For example, the vehicle 10 may send information to a client regarding a position of the vehicle 10 and business contents (a shop name, a list of products, or others) via the communication device. A client may send information regarding a position of the client and a request (requesting a delivery service, movement of the shop, or others). A crew of the vehicle 10 who have received the request from the client may perform the requested task.

A structure of the above vehicle 10 is described. As shown in FIG. 1, the vehicle 10 does not include a hood nor a trunk. The vehicle 10 has a substantially box-shaped body with the front and rear surfaces disposed substantially upright. The vehicle 10 includes eight wheels in total, two wheels at each of the four corners. Specifically, the vehicle 10 includes a pair of first front wheels **12*f*1 which are disposed on both sides of the vehicle around a front end of the vehicle, a pair of second front wheels 12*f*2 which are disposed at the rear and in the vicinity of the first front wheels 12*f*1, a pair of first rear wheels 12*r*1 which, are disposed on both sides of the vehicle around a rear end of the vehicle, and a pair of second rear wheels 12*r*2 which are disposed at the front and in the vicinity of the first rear wheels 12*r*1. In the description below, when the description does not specifically refer to either one of the first and second pairs of wheels, the suffixes 1 and 2 following the letters "f" and "r" are omitted and the wheels referred to as the "front wheels 12*f*" or the "rear wheels 12*r*", When the description does not specifically refer to either one of the front and rear pairs of the wheels, the wheels are referred to as the "wheels 12**".

Such an eight wheel structure of the vehicle 10 can reduce the load on each wheel 12, making it possible to use small-diameter wheels 12. The small-diameter wheels 12 can achieve a lower floor level such that a spacious passenger compartment can be obtained. The small diameter wheels 12 can also achieve a large display area of a display 16 described below.

A front display **16*f*, a rear display 16*r*, and side displays 16*s* for displaying images and videos are disposed on exterior surfaces at the front, rear, and sides of the vehicle body. In the description below, when the description does not specifically refer to any one of the front, rear or sides, the suffix letters are omitted referred to as the "display 16". In FIGS. 1 to 3, shaded portions indicate the areas which function as the display 16. Images and videos displayed on the display 16 are not limited. For example, images and videos for advertising products or services can be displayed. Such images and videos may include a name and products of a shop operating in the vehicle 10. The display 16** may also display information on a driving status of the vehicle, such as the travel direction or change of the travel direction, or messages to surrounding public.

The display 16 includes one or more display panels. As a display panel of the display 16, a display such as a liquid crystal display or an organic electroluminescent display can be used. The display panels of the display 16 may be an opaque display which does not allow light to pass through or a transparent display which allows light to pass through when no images or videos are displayed.

When the opaque display is disposed at the front, rear, and sides of the vehicle body, a window allowing a view of the external environment cannot be disposed. However, because the vehicle 10 is automatically driven as described above, there is no need for a crew to view the external environment. No problems will occur even when most areas of the exterior surfaces of the vehicle body are covered with the opaque displays. If view of the external environment is desired for reasons other than driving, a display may also be disposed inside a passenger compartment such that external views captured by an optical camera or other devices installed for automatic operation can be displayed on the display in the passenger compartment.

In another embodiment, a transparent display may be used. In this case, the transparent display may also be used as a window glass of the vehicle 10. Specifically, the transparent display may be fitted into an opening which is formed in the body of the vehicle 10 as a window. In this case, the transparency of the window glass can be adjusted by adjusting a display area and density of the image or the video on the transparent display. In other words, the transparent display may be used as an adjustable darkness tinted window.

In this embodiment, the size of the display 16 is made larger relative to the size of the vehicle 10 in order to enhance an advertisement or warning effect by the display 16. Each side display **16*s* which is easily noticeable from outside the vehicle has a size which occupies almost the entire area of the side surface of the vehicle 10. Specifically, as shown in FIG. 1, the side display 16***s* disposed on either or both sides of the vehicle 10 stretches from around the top edge of the body down to a position lower than the top of the wheels 12 along a vertical axis. Along a longitudinal axis, the side display 16*s* stretches wider titan between the rear end of the first front wheel 12*f*1 and the front end of the first rear wheel 12*r*1 (wider than between the internal ends of the wheels 12). The front and rear ends of the lower edge of the side display 16*s* curve or bend upwards to avoid overlapping with the wheels 12. In other words, the side display 16*s* has a size and shape such that the side display 16*s* stretches lower than the top of the wheels 12 with the lower corners on both sides cut to avoid overlapping with the wheels 12. By designing the side display 16*s* to have a size and shape to stretch lower than the top of the wheels 12 while avoiding overlap with the wheels 12, the side display 16*s* can be made large relative to the size of the vehicle 10. As a result, the advertising or warning effects of the side display 16*s* can be enhanced.

In the present disclosure, the front display 16*f* and the rear display 16*r*, which are respectively disposed at the front and rear of the vehicle 10, are also made to be as large as possible. Specifically, as shown in FIG. 3, the lower edge of the front display 16*f* and the rear display 16*r* is positioned lower than the top of the wheels 12. Top portions of the front and rear surfaces of the vehicle 10 are tilted towards a roof of the vehicle 10. The front display 16*f* and the ear display 16*r* stretch across the tilted surfaces.

Figure 4:
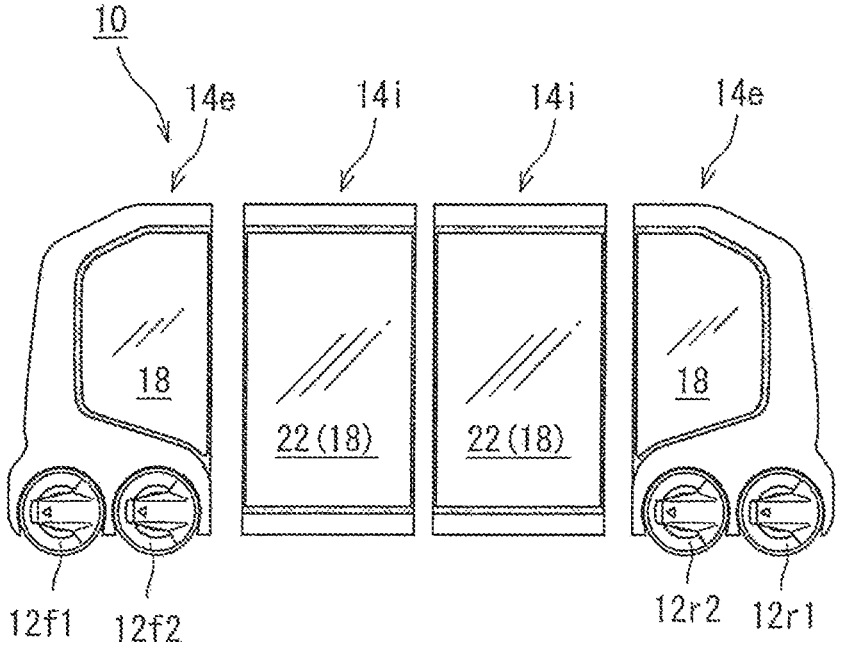
FIG. 4 is a diagram showing a single vehicle divided to multiple units.

The above-described vehicle 10 includes a combination of two or more units 14*e*, 14*i*. FIG. 4 shows a single vehicle 10 divided into units 14*e*, 14*i*. The vehicle 10 according to the present embodiment includes a pair of end units 14*e* and two or more intermediate units 14*i* which are disposed between the pair of end units 14*e*. In the description below, when the description does not specifically refer to either one of the end units and the intermediate units, the unit is referred to as the "unit 14". The end unit 14*e* functions as a front portion (front end unit) or a rear portion (rear end unit) of the vehicle 10. In other words, in the vehicle 10 according to the present embodiment, the front portion (front end unit) and the rear portion (rear end unit) have an identical structure. Each end unit 14*e* includes four wheels 12, which function as a rear wheel 12*r* or a front wheel 12*f*. A display panel 18 is disposed on a side surface of the end unit 14*e* in such a manner that the display panel 18 is arranged to avoid overlapping with the wheels 12. One end of the end unit 14*e* along the longitudinal axis of the vehicle is closed and forms a front surface or rear surface of the vehicle. The other end of the end unit 14*e* along the longitudinal axis of the vehicle is opened widely to communicate with interior space of the intermediate unit 14*i*. Although the front portion and the rear portion of the vehicle have an identical structure in the present embodiment, these portions may have different structures. In the place of the identically structured pair of the end units 14*e*, a front end unit and a rear end unit which have different structures may be used.

Each intermediate unit 14*i* is a unit 14 which has a square tube shape with both ends along the longitudinal axis opened widely. The intermediate unit 14*i* includes a shipping-container-shaped upper portion which constitutes a part of the passenger compartment and an under-floor battery which is disposed under the shipping-container-shaped upper portion (that is, under the floor panel of the passenger compartment). The shipping-container-shaped upper portion includes, on a side, an ingress/egress opening 24 for passengers entering and exiting the vehicle 10 and a door 22 which opens and closes the ingress/egress opening 24 (refer to FIG. 7). The above-described display panel 18 of the side, display 16*s* covers almost the entire area of the exterior surface of the door 22. The ingress/egress opening 24 stretches across the entire width of the intermediate units 14*i*. In this way, as shown in FIG. 7, when the doors 22 are opened, a continuous large ingress/egress opening 24 can be formed without a pillar therebetween.

Figure 7:
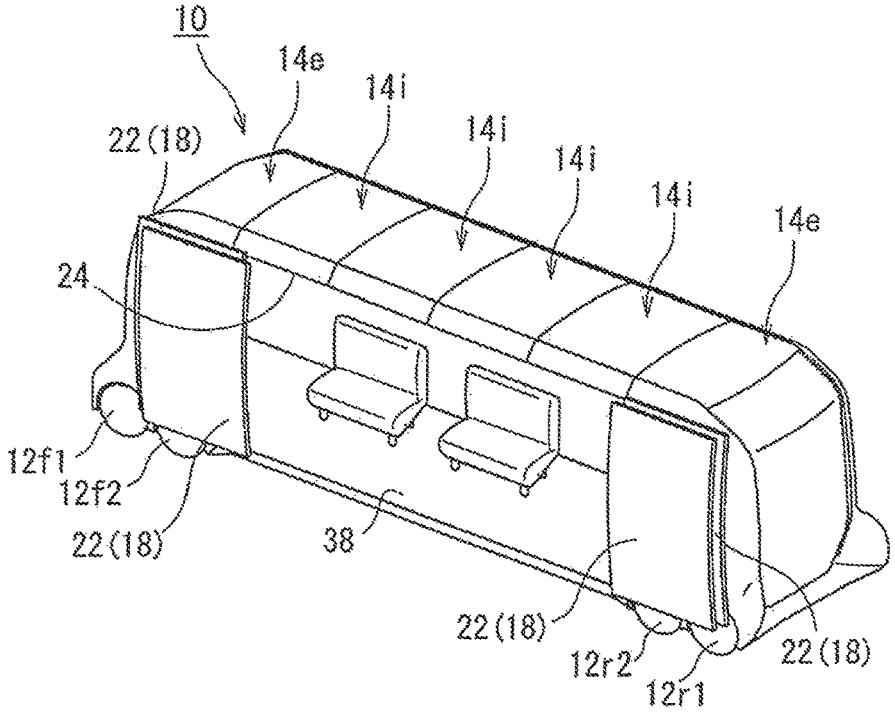
FIG. 7 is a perspective view of a vehicle with doors opened.

In some embodiments, when the ingress/egress opening 24 is pillarless as shown in FIG. 7, the ingress/egress opening 24 is provided only on one side of the vehicle 10 and to provide no ingress/egress opening 24 on the other side, in order to achieve sufficient strengthening of the vehicle body. When a frame such as a pillar is provided in the ingress/egress opening 24 or inside the passenger compartment, the ingress/egress opening 24 may be provided on both sides of the vehicle 10.

Each intermediate unit 14*i* is mechanically and electrically connectable to the end unit 14*e* or other intermediate unit 14*i*. Connecting means are not limited. For example, the unit 14 may include, on an end surface, a joint mechanism which is mechanically connectable to an end surface of another unit 14. In another embodiment, the units 14 may be mechanically connected by using a joint element (for example, folding bellows for connection) which is provided separately from the unit 14. The units 14 may be electrically connected by using various connectors. Two or more display panels 18 of the side display 16*s* are electrically connected such that the display panels 18 function as a single synchronized display. The units 14 may be connected to each other at a manufacturing site like a factory, or in a premises owned by a car dealership or the owner of the vehicle 10.

Figure 5:
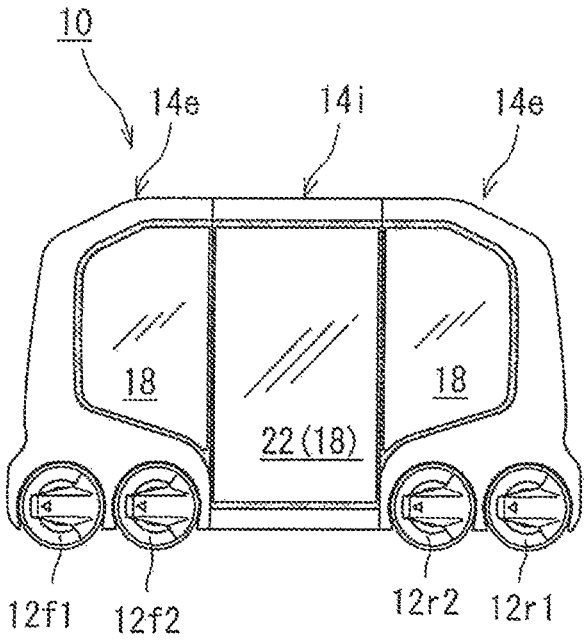
FIG. 5 is a diagram showing a short eversion of a vehicle.
Figure 6:
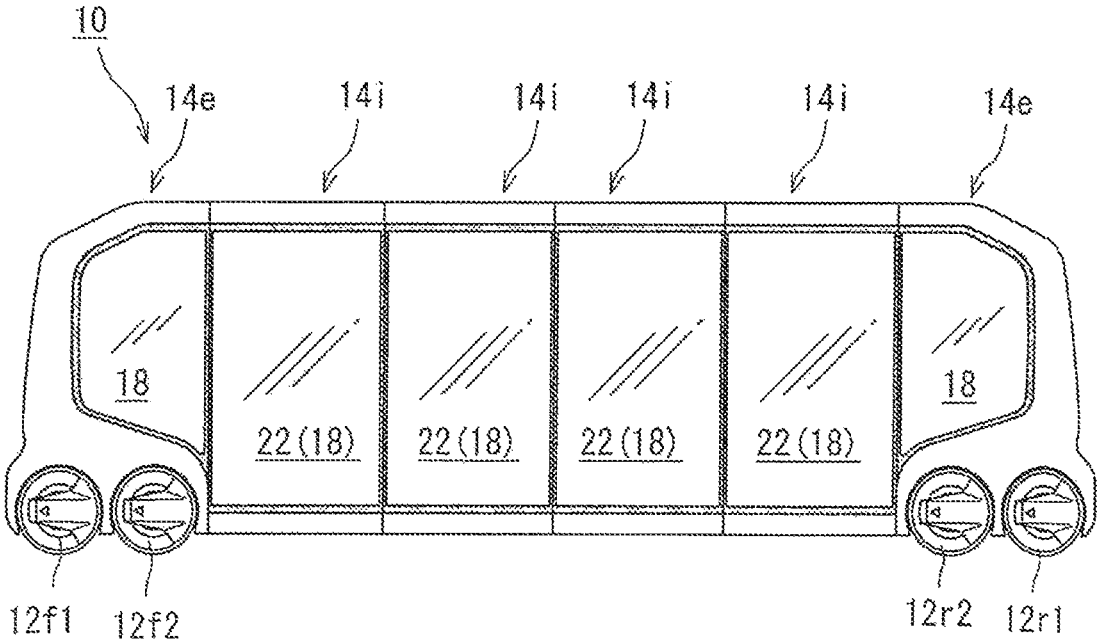
FIG. 6 is a diagram showing a long version of a vehicle.

The number of intermediate units 14*i* connectable in a single vehicle 10 is not limited but variable as required. For example, the vehicle 10 may have a "middle" configuration in which two intermediate units 14*i* are disposed between two end units 14*e*. In another embodiment, the vehicle 10 may have a "short" configuration with a single intermediate unit 14*i* as shown in FIG. 5, or a "long" configuration with four intermediate units 14*i* as shown in FIG. 6. Although only two types of units (the end units 14*e* and intermediate units 14*i* forming a pillarless ingress/egress opening 24) are combined in the above description, three or more types of units 14 may be combined. For example, in addition to or in the place of the intermediate unit 14*i* described above, a unit including the wheels 12 and disposed between the pair of end units 14*e* or a unit with a pillar in the ingress/egress opening 24 may be combined.

As described above, the door 22 is provided on a side of the intermediate unit 14*i*. The door 22 is not limited to any specific type as long as the door 22 can completely open the ingress/egress opening 24. For example, the door 22 of the intermediate units 14*i* may be a sliding door. As shown in FIG. 7, when the doors 22 slide open, the doors 22 move onto the side of the end units 14*e*. Two or more sliding doors may be overlapped in the direction of their thickness such that all the doors 22 can be disposed on a side of either one of the end units 14*e* by overlapping the two or more sliding doors in the direction of their thickness. In this way, the ingress/egress opening 24 can be widely opened.

Figure 8:
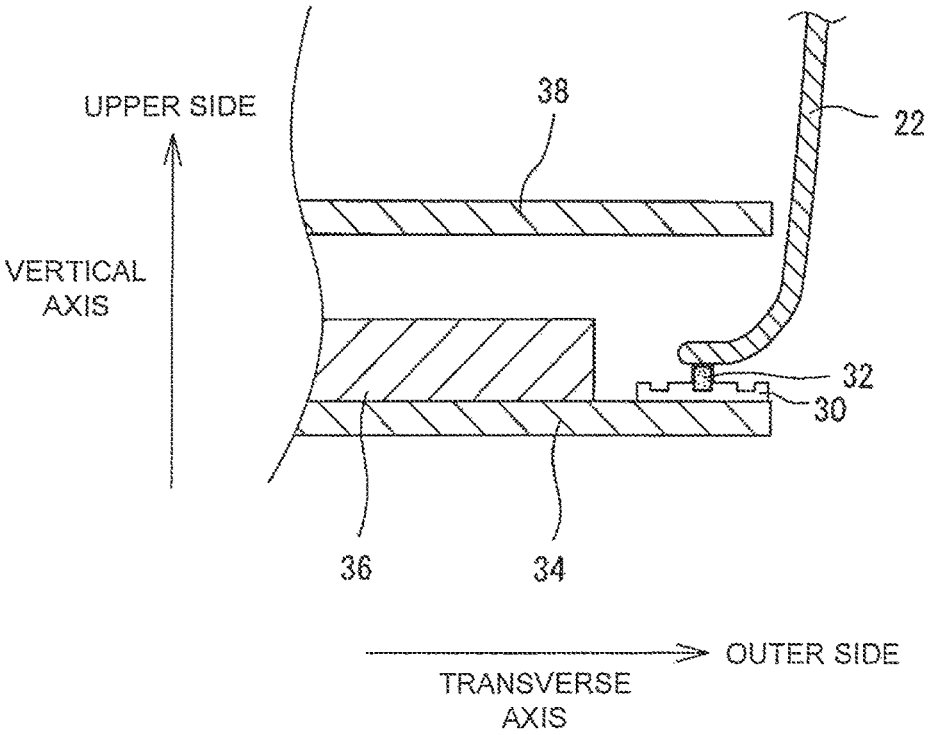
FIG. 8 is a diagram showing a guide mechanism of a door.

When a sliding door is used as the door 22, a guide mechanism for guiding the sliding door 22 is disposed. Various structures may be available for the guide mechanism. For example, the guide mechanism may include a guide rail 30 and slide rollers 32 to configure a slide mechanism of the door 22. FIG. 8 shows an example of the guide mechanism in a vertical cross sectional view of a low portion of the vehicle 10 in FIG. 8, the right side in the view indicates a transversely outer side of the vehicle and the upper side in the view indicates the vehicle upper side.

In the example shown in FIG. 8, the slide rollers 32 are disposed at a bottom portion of the door 22. The guide rail 30 for guiding the slide rollers 32 is disposed on a battery mounting surface 34. An under-floor battery 36 is disposed below a floor panel 38 so that a narrow space is allowed between the floor panel 38 and the battery mounting surface 34 for the under-floor battery 36. The guide rail 30 is disposed in this space. The slide rollers 32 and the guide rail 30 of a similar structure are al so disposed respectively at an upper portion of the door 22 and an upper portion, of the body of the vehicle 10.

FIGS. 9A to 9E are top views of the guide rail 30 disposed on the battery mounting surface 34, showing how the doors 22 slide. In FIGS. 9A to 9E, the bottom in the views indicates a transversely outer side (the right or the left) of the vehicle, and the left side in the views indicates a longitudinally end side (the front or the rear) of the vehicle. The guide rail 30 shown in FIGS. 9A to 9E guides two of the doors 22 disposed next to each other along the longitudinal axis of the vehicle to one side to overlap the doors 22 in the direction of their thickness. In the description below, the door 22 on a longitudinally end side with respect to the other door 22 is referred to as the "end door 22*e*" and the other door 22 as the "center door 22*c*".

In this case, as shown in FIGS. 9A to 9E, the guide rail 30 includes triple slide rails 30*a* extending along the longitudinal axis of the vehicle, and shift rails 30*b* extending along the transverse axis of the vehicle to link between the triple slide rails 30*a*. The slide rollers 32 disposed at a bottom portion of the door 22 move along the rails 30*a*, 30*b* and are pivotable through 90 degrees. The slide rollers 32 may be driven by a motor or other devices.

Figure 9A:
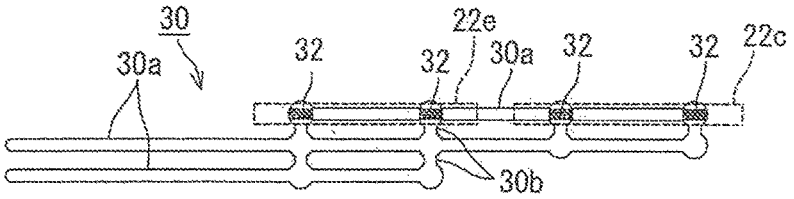
FIG. 9A shows how doors slide.
Figure 9B:
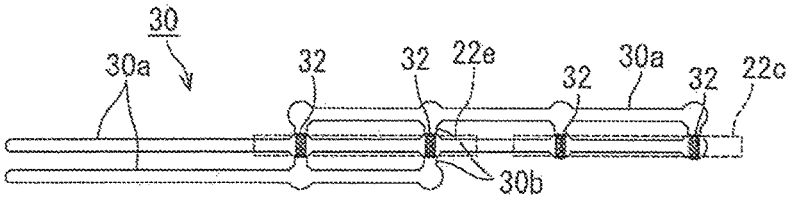
FIG. 9B shows how doors slide.
Figure 9C:
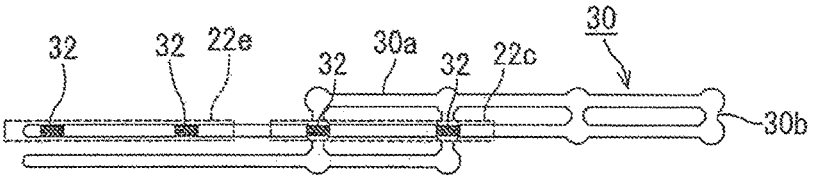
FIG. 9C shows how doors slide.
Figure 9D:
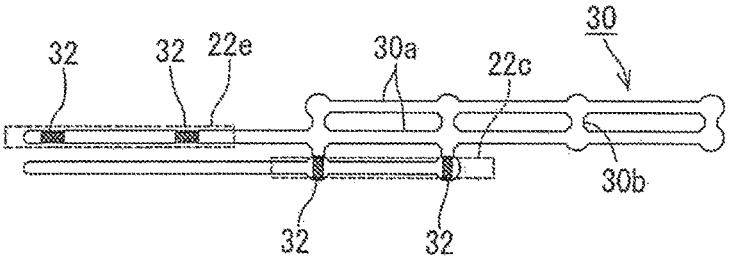
FIG. 9D shows how doors slide.
Figure 9E:
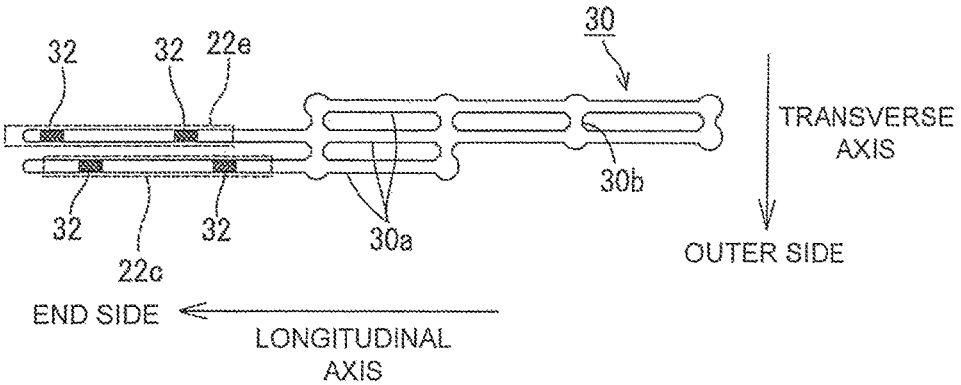
FIG. 9E shows how doors slide.

As shown in FIGS. 9A to 9E, when opening the door 22, the door 22 is slid along the vehicle longitudinal axis while being shifted along the vehicle transverse axis, as necessary. Specifically, as shown in FIG. 9A, when the door 22 is closed, the slide rollers 32 of the end door 22*e* and the center door 22*e* are disposed on the most inner slide rail 30*a*. As shown in FIG. 9B, when opening the door 22, the slide rollers 32 are at first pivoted 90 degrees to enable movement along the transverse axis of the vehicle. Then, the slide rollers 32 are moved along the shift rails 30*b* to the next outer rail. As shown in FIG. 9C, after the slide rollers 32 are pivoted again to enable movement along the longitudinal axis of the vehicle, the slide rollers 32 are moved along the center slide rail 30*a* towards a front or rear end side. As shown in FIG. 9D, after the end door 22*e* is moved onto the side of either one of the end units 14*e*, the slide rollers 32 of the center door 22*c* alone are pivoted 90 degrees and moved along the shift rails 30*b*. As such, the center door 22*c* alone is moved to the next outer rail. Then, as shown in FIG. 9E, the center door 22*e* is moved to the front or rear end side along the most outer slide rail 30*a*. This completes the opening operation of the doors 22.

The structure of the door 22 described above is merely one example. Other structures may be used as long as the ingress/egress opening 24 can be widely opened. For example, although the rails are used to slide the doors 22, the doors 22 may be slid by using magnetic force.

Figure 10:
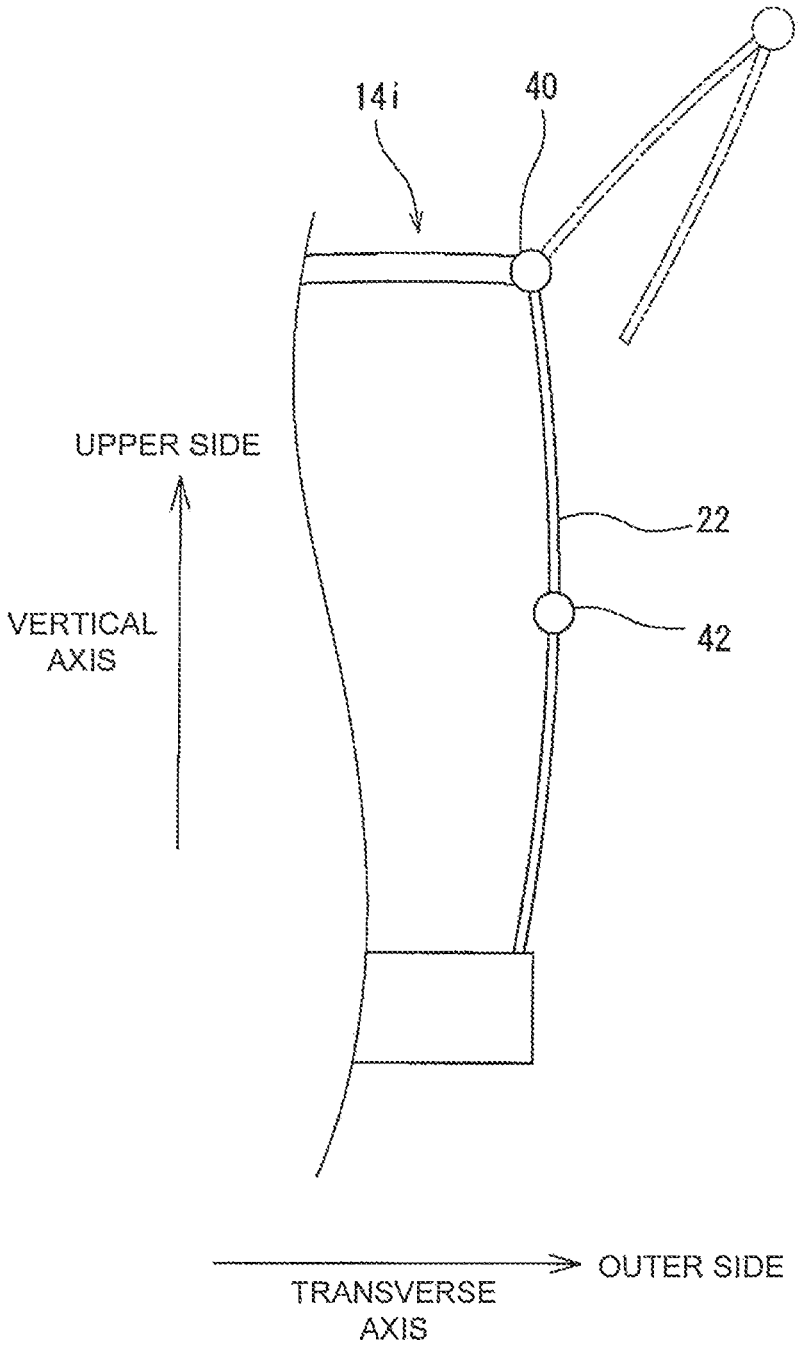
FIG. 10 shows another embodiment of a door.

The doors 22 are not limited to a sliding door. The doors 22 may be any type of doors. For example, as shown in FIG. 10, a swing-up door which swings up by pivoting about a hinge 40 disposed at an upper edge of the door 22 may be used. In order to reduce protrusion of the door 22, one or more additional hinges 42 may be provided around a vertical center position of the door 22 to fold the door 22 into two or more. The swung-up door 22 may be enclosed in a roof storage space of the vehicle 10. In any case, a wide opening may be achieved by moving the door 22 to a position not overlapped with the ingress/egress opening 24 when the door 22 is opened. The display panel 18 disposed on an exterior surface of each door 22 may be turned OFF when the door 22 is opened or kept ON to continue display of images and videos.

As clearly described above, the vehicle 10 according to the present embodiment includes a pair of end units 14*e* (vehicle end portions) at both ends along the vehicle longitudinal axis. Each of the two end units 14*e* has functions both as a vehicle front portion and a vehicle rear portion. For example, a vehicle front portion and a vehicle rear portion typically includes a headlamp and a tail lamp respectively. As shown in FIG. 3, the end unit 14*e* according to the present embodiment includes a lamp 20 which functions as both the headlamp and the tail lamp. When the end unit 14*e* functions as a vehicle front portion, the lamp 20 illuminates in a color suitable for a headlamp (white, or any other colors) in accordance with darkness in the environment, whereas when the end unit 14*e* functions as a vehicle rear portion, the lamp 20 illuminates or flashes in a color suitable for a tail lamp (red, or any other colors) in response to activation of a brake.

According to the present embodiment, when the travel direction of the vehicle 10 should be reversed, the vehicle 10 does not perform a U-turn but instead the direction of rotation of the wheels 12 is reversed. In response to the reversing of the travel direction of the vehicle 10, the functions of the two end units 14*e* are switched so that the end unit 14*e* which had been functioning as the vehicle front portion before the reverse functions as the vehicle rear portion, whereas the end unit 14*e* which had been functioned as the vehicle rear portion before the reverse functions as the vehicle front portion. In this way, the travel direction of the vehicle can be reversed without performing a U-turn.

Figure 11A:
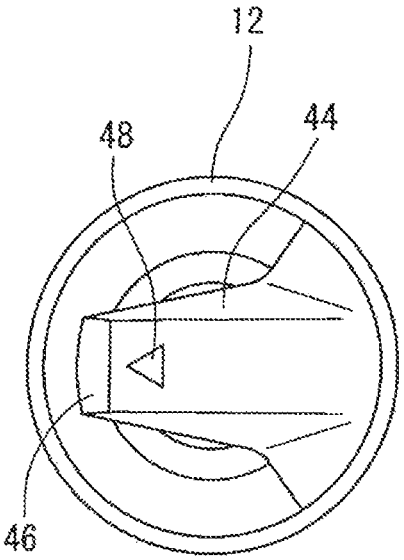
FIG. 11A is a diagram used to describe how a direction of rotation of a wheel is reversed.
Figure 11B:
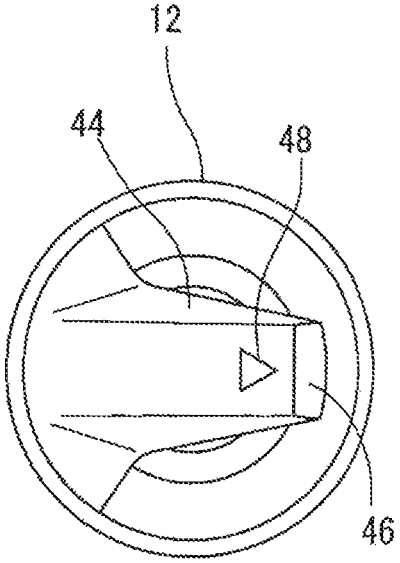
FIG. 11B is a diagram used to describe how a direction of rotation of a wheel is reversed.

The vehicle 10 according to the present embodiment is an in-wheel motor type. A traction motor is incorporated into each of the wheels 12. As shown in FIG. 11A, a wheel cover 44 is provided on an outer side surface of each wheel 12. A duct through which cool air is blown to the traction motor (in-wheel motor) is disposed on the wheel cover 44. As shown in FIG. 11B, when the traveling direction of the vehicle 10 is reversed, the wheel cover 44 is rotated 180 degrees to direct an ail intake port 46 in the opposite direction. In this way, because the air intake port 46 is always directed towards the front in the traveling direction, wind can be efficiently taken into the duct while driving. A mark 48 (for example, an arrow) indicating a traveling direction may be placed on the wheel cover 44. When the wheel cover 44 is rotated 180 degrees, the mark is directed in the opposite direction. In this way, the traveling direction of the vehicle 10 can be clearly displayed. A description of the structure of the in-wheel motor is omitted because well-known techniques can be applied.

Figure 12A:
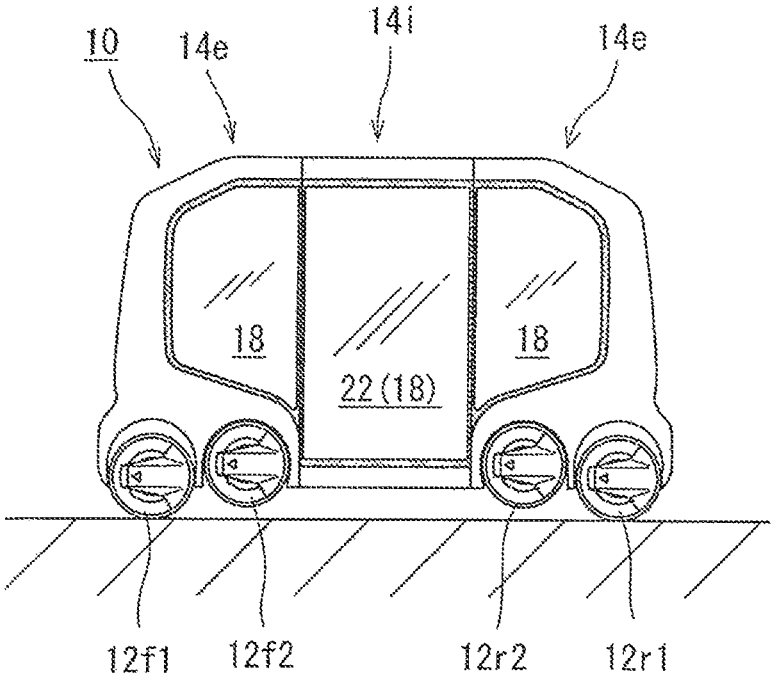
FIG. 12A shows how a vehicle is turned.
Figure 12B:
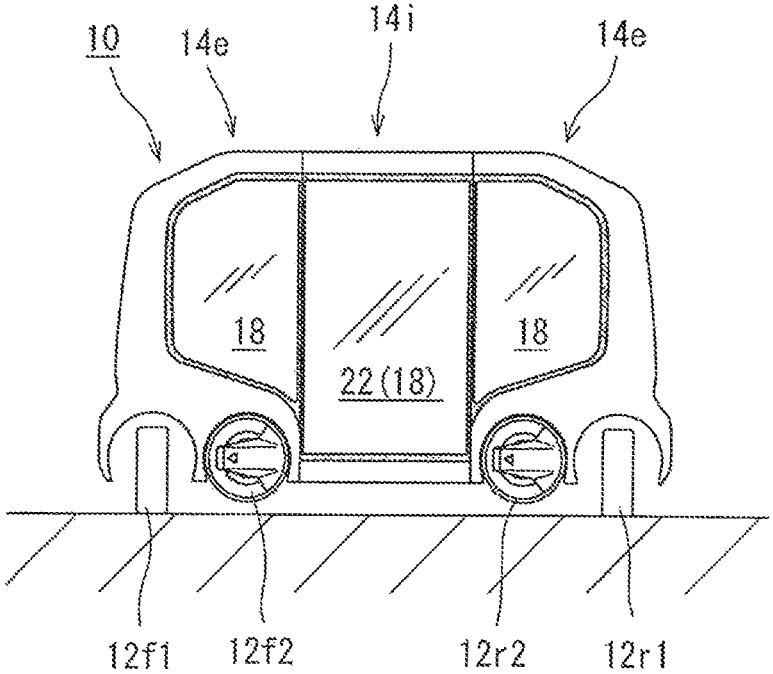
FIG. 12B shows how a vehicle is turned.

As described above, the vehicle 10 includes, a total of eight wheels 12, two at each of the four corners of the vehicle 10. According to the present embodiment, when the vehicle 10 makes a large turn, the front-most pair a d the rear-most pair of the wheels 12 (the pair of first front wheels 12*f*1 and the pair of first rear wheels 12*r*1) are steered. Specifically, as shown in FIG. 12A the pair of first front wheels 12*f*1 and the pair of first rear wheels 12*r*1 alone are lowered to lift the pair of second front wheels 12*f*2 and the pair of second rear wheels **12*r*2 off the ground. With the wheels maintained in this state, the vehicle 10 is driven by steering only the first front wheels 12*f*1 and the first rear wheels 12*r*1. When the turning maneuver is finished, the first front wheels 12*f*1 and the first rear wheels 12*r*1 are lifted and the vehicle 10** is driven by the eight wheels again.

Figure 13:
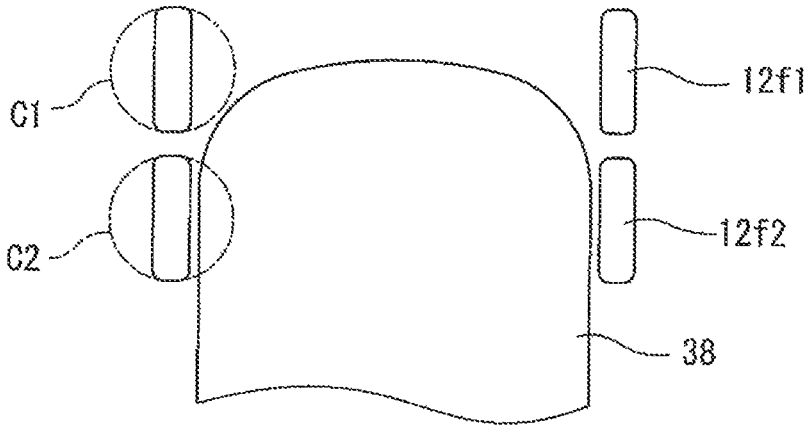
FIG. 13 shows positional relationships between wheels and a front panel.

The above structure enables the vehicle 10 to make a turn on the spot, enhancing benefits of a small turning radius. Because the first front wheels **12*f*1 and the first rear wheels 12*r*1 are disposed on longitudinally outer sides of the vehicle, these wheels can make a wide turn without interfering with the floor panel 38. This is described with reference to FIG. 13. FIG. 13 shows a positional relationship among the first front wheels 12*f*1, the second front wheels 12*f*2, and the floor panel 38. In FIG. 13, circles C1 and C2 respectively show the space required for turning the first front wheels 12*f*1 and the second front wheels 12*f*1**.

As shown in FIG. 13, the second front wheels **12*f*2 are disposed more rearward than the front edge of the floor panel 38. One of the side edges of each second front wheel 12*f*2 is disposed in the vicinity of a side edge of the floor panel 38. If an attempt is made to perform a wide turn with the second front wheels 12*f*2 the second front wheels 12*f*2 and the floor panel 38 would interfere with each other. In contrast, the center of rotation and turn of each first front wheel 12*f*1 is disposed more forward than the front edge of the floor panel 38. The front edge of the floor panel 38 is curved to protrude forward such that the width becomes narrower at a more forward position. In this way, when the first front wheels 12*f*1 are widely turned, the interference between the first front wheels 12*f*1 and the floor panel 38** is not likely to occur.

Although the first front wheels **12*f*1 and the first rear wheels 12*r*1 are turned on the ground in the above description, the first front wheels 12*f*1 and the first rear wheels 12*r*1 may be turned while being lifted oft the ground and lowered back to the ground afterwards. Specifically, in order to turn the wheels, the first front wheels 12*f*1 and the first rear wheels 12*r*1 may be turned after the second front wheels 12*f*2 and the second rear wheels 12*r*2 are lowered to lift the first front wheels 12*f*1 and the first rear wheels 12*r*1 off the ground. Then, the first front wheels 12*f*1 and the first rear wheels 12*r*1 may be lowered and the second front wheels 12*f*2 and the second rear wheels 12*r*2 may be lifted to place the first front wheels 12*f*1 and the first rear wheels 12*r*1 on the ground. Such a configuration can largely reduce the load when turning the first front wheels 12*f*1 and the first rear wheels 12*r*1**.

The above description referred to making a wide turn. When making a small turn, the second front wheels **12*f*2 and the second rear wheels 12*r*2 may also be turned. Specifically, with all the eight wheels 12*f*1, 12*f*2, 12*r*1, and 12*r*2 maintained on the ground, the second front wheels 12*f*2 and the second rear wheels 12*r*2 may be turned together with the first front wheels 12*f*1 and the first rear wheels 12*r*1**.

The above described embodiments are merely examples. Other embodiments are also applicable as long as the display 16 disposed on at least one side surface of the vehicle 10 stretches lower than the top of the wheels 12 along the vertical axis, and wider than between inside ends of the wheels 12 along the longitudinal axis. For example, although the vehicle 10 is described as an automatically driven vehicle in the above description, the present disclosure is not limited to automatically driven vehicles, but may be applied to vehicles which are driven by a driver in the vehicle. The display 16 of the present disclosure is not limited to being applied to the vehicle 10 which includes two or more linked units 14, but is also applicable to other types of vehicles 10. Although the vehicle 10 is described to run on public roads in the above description, the vehicle 10 may be provided for a specific private property (such as amusement parks, parking spaces of large facilities, or golf courses).

The invention claimed is:

1. A vehicle comprising:

a substantially box-shaped body;

a plurality of wheels disposed on four corners of the vehicle; and at least one side display disposed on either or both exterior side surfaces of the body for displaying an image or video, wherein the at least one side display stretches lower than a top of the plurality of wheels along a vertical axis of the vehicle and wider than between inside ends of the plurality of wheels along a longitudinal axis of the vehicle, and a lower edge of the at least one side display is curved or bent upwards at both front and rear ends to avoid overlapping with the plurality of wheels.

2. The vehicle according to claim 1, wherein the plurality of wheels comprises a pair of first front wheels disposed on both sides of the vehicle in the vicinity of a from end of the vehicle, a pair of second front wheels disposed at the rear and in the vicinity of the pair of first front wheels, a pair of first rear wheels disposed on both sides of the vehicle in the vicinity of a rear end of the vehicle, a pair of second rear Wheels disposed at the front and in the vicinity of the pair of first rear wheels, and along the longitudinal axis of the vehicle, the side display stretches wider than between inside ends of the pair of first front wheels and the pair of first rear wheels.

3. The vehicle according to claim 1, wherein the vehicle comprises a front end unit disposed at the front of the vehicle;

a rear end unit disposed at the rear of the vehicle; and at least one intermediate unit disposed between the front end unit and the rear end unit, wherein the front end unit, the rear end unit, and the at least one intermediate unit are mechanically and electrically connected along the longitudinal axis of the vehicle, each of the front end unit, the rear end unit, and the at least one intermediate unit comprises at least one display panel disposed on either or both exterior side surfaces of the unit, and the side display comprises the plurality of display panels.

4. The vehicle according to claim 3, wherein on at least one side surface, each of the at least one intermediate unit comprises ingress/egress opening stretching across an entire width of the intermediate unit along the longitudinal axis of the vehicle, and a door which opens and closes the ingress/egress opening, and each of the plurality of display panels of the side display stretches across substantially an entire surface of the door.

5. The vehicle according to claim 4, wherein the vehicle comprises at least three of the intermediate units, the door is a sliding door which slides along the longitudinal axis of the vehicle;

when opened, two or more of the doors overlap in the direction of their thickness on a side of the front end unit or the rear end unit.

6. The vehicle according to claim 1, wherein the vehicle comprises a pair of vehicle end portions at both of the front and rear ends of the vehicle, each of the end portions has functions both as a vehicle front end portion and a vehicle rear end portion, when the traveling direction of the vehicle is reversed, the rotation direction of the plurality of wheels is reversed, and the functions of the vehicle end portions are switched such that the vehicle end portion serving as the vehicle front end portion before the reverse becomes the vehicle rear end portion, whereas the vehicle end portion serving as the vehicle rear end portion before the reverse becomes the vehicle front end portion.

* * * * *